US007938167B2

(12) United States Patent
d'Hone et al.

(10) Patent No.: US 7,938,167 B2
(45) Date of Patent: May 10, 2011

(54) METHOD AND DEVICE FOR TREATING A SURFACE OF A WORK PIECE

(75) Inventors: André d'Hone, Krefeld (DE); René Leenen, Willich (DE)

(73) Assignee: ThyssenKrupp Nirosta GmbH, Krefeld (SE)

( * ) Notice: Subject to any disclaimer, the term of this patent is extended or adjusted under 35 U.S.C. 154(b) by 476 days.

(21) Appl. No.: 12/094,054

(22) PCT Filed: Nov. 20, 2006

(86) PCT No.: PCT/EP2006/068683

§ 371 (c)(1),
(2), (4) Date: Aug. 21, 2008

(87) PCT Pub. No.: WO2007/057469

PCT Pub. Date: May 24, 2007

(65) Prior Publication Data

US 2009/0090484 A1 Apr. 9, 2009

(30) Foreign Application Priority Data

Nov. 18, 2005 (DE) ..... 10 2005 054 996

(51) Int. Cl.
*B22D 11/06* (2006.01)
*B22D 11/16* (2006.01)

(52) U.S. Cl. ..... 164/479; 164/480; 164/428; 164/429; 164/452

(58) Field of Classification Search ..... 164/428, 164/429, 452, 463, 479, 480
See application file for complete search history.

(56) References Cited

U.S. PATENT DOCUMENTS

| | | | | |
|---|---|---|---|---|
| 5,060,714 | A * | 10/1991 | Yamauchi et al. | 164/428 |
| 6,296,046 | B1 | 10/2001 | Jeong et al. | 164/452 |
| 7,066,238 | B2 * | 6/2006 | Hohenbichler et al. | 164/480 |
| 2006/0054298 | A1 | 3/2006 | Hohenbichler et al. | 164/480 |

FOREIGN PATENT DOCUMENTS

| | | | |
|---|---|---|---|
| DE | 100 56 916 | A1 | 5/2002 |
| JP | 2000 117397 | A | 4/2000 |
| WO | 99/32247 | A | 7/1999 |
| WO | 2004/000487 | A | 12/2003 |

OTHER PUBLICATIONS

International Search Report for PCT/EP2006/068683.

* cited by examiner

*Primary Examiner* — Jessica L Ward
*Assistant Examiner* — Kevin E Yoon
(74) *Attorney, Agent, or Firm* — Proskauer Rose LLP

(57) ABSTRACT

A method for operating a two-roll casting machine for casting molten metal into cast strip, which machine has two casting rolls which are each rotatively driven in opposite directions about an axis of rotation and between them delimit a casting gap on its longitudinal sides, with side plates that can be placed on the casting rolls, which side plates seal the casting gap on its narrow sides in the casting operation, bridging the casting gap with a refractory material, wherein the side plates are moved during the casting operation in a direction which is aligned parallel to the direction of conveying in which the cast strip leaves the casting gap. With such a method the formation of grooves distorting the casting result and the casting operation can be suppressed with increased certainty and the service life of the side plates can be increased, compared to the prior art.

6 Claims, 3 Drawing Sheets

METHOD AND DEVICE FOR TREATING A SURFACE OF A WORK PIECE

CROSS-REFERENCE TO RELATED APPLICATIONS

This application is a National Phase Application of International Application No. PCT/EP2006/068683, filed on Nov. 20, 2006, which claims the benefit of and priority to German patent application no. DE 10 2005 054 996.9-24, filed Nov. 18, 2005. The disclosure of each of the above applications is incorporated herein by reference in their entirety.

FIELD OF THE INVENTION

The invention relates to a method for operating a two-roll casting machine for casting molten metal, particularly molten steel, into cast strip, with two casting rolls which are each rotatively driven in opposite directions about an axis of rotation and between them delimit a casting gap on its longitudinal sides, with side plates that can be placed on the casting rolls, which side plates seal the casting gap on its narrow sides in the casting operation since they bear against the front sides of the casting rolls, bridging the casting gap with a refractory material, wherein the side plates are moved during the casting operation in a vertical direction which is aligned parallel to the direction of conveying in which the cast strip leaves the casting gap, and wherein gap-like grooves are formed in the refractory material of the side plates as the operating time increases.

BACKGROUND

In casting strip according to the two-roll method the smelting space on the front sides of the casting rolls is normally sealed with side plates which support a ceramic insert forming the actual seal. This ceramic is displaced axially during the casting process in the direction of the casting rolls in order to compensate on the one hand for the removal of the ceramic material caused by the abrasion of the casting rolls and on the other hand for the wear of the insert which is brought about as a result of abrasion by the strip edge forming in the casting gap and a chemical reaction.

In practice, it has been shown that the wear caused by the strip edges on the inserts of the side plates has a decisive influence on their service life and hence on the entire economy of a strip casting plant of the type concerned. If the wear caused by the strip edges is not counteracted in time, gap-like grooves are formed in the inserts as the operating time increases, which grooves depart from the surface of the respective insert assigned to the casting gap and extend along the contact region against which the circumference of the casting rolls bears on the peripheral surfaces of the insert. According to the strength of the melt, which increases in the direction of escape from the casting gap, the width and depth of the grooves increase here in the direction of the narrowest region of the casting gap on which the metal shells solidified on the casting rolls are pressed together. Due to extrusion effects the gap-like grooves are able to work into the regions of the insert ceramic lying between the front faces of the casting rolls and the contact faces of the inserts assigned to them. The gap-like grooves enlarged in this manner then have a T-shaped cross-section. Melt penetrating the T-gap-like grooves may solidify on the front faces of the casting rolls. The solidified melt pieces, also called "T-edges" in the technical jargon, are entrained by the casting rolls and may then considerably distort the results of casting operation and casting result.

If such grooves are formed on the insert molten metal may penetrate these grooves and solidify in them. Such solidifications vary on the strip escaping from the casting gap in that the edge of the strip, viewed in cross-section, has a "T-shape" where thin webs of solidified metal are formed on the edges in the region of the transition of the narrow sides to the longitudinal sides of the strip cross-section, which webs can lead to considerable problems in the casting operation and have a decisively negative influence on the quality of the cast strip obtained. For example, the metal penetrating between the insert and the respective casting roll is cooled in the casting gap far more intensely than the volume of metal located centrally in front of the insert. Whilst the solidified metal penetrating between the respective casting roll and the insert is entrained over the width after escaping from the casting gap due to strip shrinkage, the central section of the strip sags due to the influence of gravity after escaping from the casting gap. Consequently, stresses are generated in the strip material not yet solidified, which bring with them the risk of formation of longitudinal cracks in the finished cast strip. In extreme cases the T-edges separated as a result of this and rotating with the casting rolls can result in an interruption in casting.

WO 2004/000487 discloses that the formation of grooves can be counteracted by moving the side plates with their inserts after reaching a stationary casting process, in a first interval of time in the axial direction of the casting rolls against the front sides of the casting rolls, then in a second interval of time in a direction that is parallel to the direction of conveying, with which the cast strip leaves the cast strip. In this case the first interval of time of the axial movement can at least partially overlap the second interval of time of the movement that takes place parallel to the direction of conveying of the strip. However, the first interval of time should in each case always commence before the second begins to ensure perfect grinding of the side plate inserts. The feed, with which the side plates are moved with their inserts in the direction of conveying of the cast strip, is in this case within the range of 50 mm per hour, preferably within the range of 1 mm to 30 mm per hour of casting time.

Practical tests have shown that although the risk of formation of grooves and the accompanying problems can be reduced by the procedure disclosed in WO 2004/000487, it was shown that this reduction was not yet sufficient to avoid the formation of grooves occurring to a greater extent under the conditions prevailing in practice with sufficient certainty for the period of operation.

In addition to the prior art explained above, DE 100 56 916 A1 discloses a further method for casting a metal strip on a two-roll casting machine whose casting gap, formed between the two casting rolls, is also sealed on its short sides by side plates supporting an insert of refractory material. Here, the side plates are displaced along an approximately vertical plane in the direction of casting to optimize the sealing, an oscillating vibration being superimposed upon the displacement. The purpose of this measure is to avoid particle accumulations, so-called "crusts", adhering to the side plates, solidifying at an early stage. These crusts may lead, subject to local limitations, to accumulations on the side plates, which extend into the metal present in the casting gap and already solidified in the regions adjacent to the casting rolls, but between them still in the molten state. Problems of this nature occur particularly in two-roll casting plants in which the temperature and flow conditions, in particular, are unfavorable in the side plate region. If the particles adhering to the side plates become detached there is a local increase in strip thickness in the edge region. Because of the massive widening of the strip that is still possible during strip casting in the condition after the two-roll process, there may as a result be an extreme pressure increase on the laterally limiting inserts of the side plates, this increase provoking a fracture of the same, particularly in the lower region. These fractures of the lower insert sections, and also fractures caused by other effects, generally result in the lower insert edge displaced upwards and newly produced by the fracture being located below the process-dependent strip shell contact point, the so-called "kissing point". Equally inadequate positioning of the lower insert edge may also be caused by unfavorable process parameters which initiate a displacement of the kissing point under the lower insert edge. These relationships result in an undesirable so-called "drop edge formation", where the material, still in the molten state, is forced out of the casting gap or runs out directly from it in the extreme case due to the strip widening force.

In practice, this risk is counteracted by lowering the side plates for a short time where the positioning of the lower edge is correspondingly inadequate. The problem of the formation of gap-like grooves, which occurs, in particular, in highly developed and extremely efficient two-roll casting machines, is not discussed in DE 100 56 916 A1.

SUMMARY OF THE INVENTION

On the basis of the prior art explained above, an aspect of the invention provides a method in which, with increased certainty, the formation of grooves distorting the casting result and the casting operation is suppressed and the service life and certainty with which a stable casting operation can be maintained is increased relative to the prior art.

An embodiment of the invention is directed to a method for operating a two-roll casting machine for casting molten metal, particularly molten steel, into cast strip, with two casting rolls which are each rotatively driven in opposite directions about an axis of rotation and between them delimit a casting gap on its longitudinal sides, with side plates that can be placed on the casting rolls, which side plates seal the casting gap on its narrow sides in the casting operation since they bear against the front sides of the casting rolls, bridging the casting gap with a refractory material, wherein the side plates are moved during the casting operation in a vertical direction which is aligned parallel to the direction of conveying in which the cast strip leaves the casting gap, and wherein gap-like grooves are formed in the refractory material of the side plates as the operating time increases.

According to the invention the side plates with their insert are adjusted from the start of the casting operation taking into consideration the cast length of the cast strip. By making reference, according to the invention, in each case to the cast strip length directly dependent on the respective casting speed, consideration is given in the adjustment of the side plates to the strip thickness produced in each case and hence the conditions actually prevailing in the casting gap. Regardless of the thickness of the respective strip, this ensures that grooves are formed in any case at the critical narrowest point of the insert, even after a long operating time, to the extent that they do not present a risk to the casting operation and are also uncritical as far as the quality of the strip obtained is concerned.

In this connection, the invention makes the assumption, based on empirical values, that if the side plates are not moved as a result of the formation of the grooves the point at which the melt penetrates the recess forming between the insert and casting roll lies, in the most unfavourable case, at approximately ¾ of the height of the bath level measured above the outlet of the casting gap and the width of the respectively formed grooves is equal, in a good approximation, to a maximum of half the strip thickness. On this assumption the rate of lowering at which the side plates have to be lowered in the vertical direction can then be estimated taking into consideration the progress of the formation of the grooves in the axial direction of the casting rolls by the method according to the invention in order to avoid the formation of grooves.

What is of decisive importance here is that the movement of the side plates according to the invention takes place continuously and that a displacement of the inserts with an increased rate of movement due to unfavorable process parameters or due to a fracture of the lower insert edges only takes place along the casting direction. Only in this way can it be ensured that in the region of the critical sections of the casting gap in which the strip edges already solidified move along the insert, sufficient unworn insert material is always tracked so that deep grooves are not formed in the contact region between the insert and the circumference of the casting roll.

What is also particularly important for the success of the invention is that the movement performed according to the invention is initiated immediately with the casting operation. The region in which molten metal could penetrate between the insert and the casting roll is therefore displaced from the beginning in the direction of conveying of the strip, i.e. when the direction of conveying is aligned vertically downwards. Because of the continuous displacement of the side plate in the direction of conveying of the cast strip, the cast molten metal has less time for solidification in the critical region, so that the abrasive wear caused by it is low.

The adjustment according to the invention results in a marked extension of the service life of the side plates used in a two-roll casting machine. For example it has been shown that the positioning rate with which the side plates have to be moved, in addition to the movement taking place according to the invention in the axial direction of the strip, i.e. along the axes of rotation and longitudinal axes of the casting rolls, can be reduced in a machine operated according to the invention to approximately one third of the positioning rates set in conventional two-roll casting machines. The loss of thickness of the side plates occurring during the casting time is correspondingly small, so that a far longer service life of the side plate inserts than in the prior art is generally achieved.

Practical tests have shown that in the procedure according to the invention and at casting speeds of 10-150 m/min which are normal today, good casting results can be achieved when the side plates are moved at a rate of movement of at least 0.1 mm per km of cast strip to a maximum of 50 mm per km of cast strip, preferably 0.5-1.5 mm/km of cast strip, in the direction of conveying of the cast strip.

The specifically selected rate of movement of the adjustment according to the invention can in this case be set within the above-mentioned limits taking into consideration the properties of the processed molten metal and the other marginal casting conditions. For example, if high temperature resistant steel qualities are cast and inserts with a lower hardness are used, higher rates of movement can be set to compensate for the wear of the insert, i.e. higher than is the case if less temperature resistant molten steel are cast using harder inserts. For example, when rapid solidification of the metal and correspondingly high strip forming forces are required due to high cooling power or a corresponding composition of the process gas used to encourage the formation of the strip shells, higher rates of movement can also be set to avoid the formation of grooves, i.e. higher than under process conditions in which the cast metal solidifies less quickly in the casting gap and the inserts are therefore subject to less wear.

If drop edges are observed on the cast strip, despite the method according to the invention, this result may be reacted to by ensuring that the insert is displaced in the casting direction at an increased rate of movement until the strip escaping from the casting gap again has properly formed edges. The limiting of the rate of movement to a maximum of 50 mm per km of cast strip serves in this connection to limit the vertical and horizontal forces to the extent that no insert fracture occurs due to excessive loading, taking into consideration the casting roll surface roughness now required and the normal insert hardnesses that are now available.

If there is a variation in the process parameters it may be sensible to increase the rate at which the side plates are moved according to the invention, to prevent the formation of drop edges. For example, if the thickness of the strip to be produced is varied, or the rate of solidification of the melt is increased due to a higher cooling power or the use of a specially composed process gas, it may be appropriate to increase the rate of movement of the movement according to the invention of the side plates in order to take account of the variations in wear conditions associated with these changes.

Depending upon how strongly the material of the side plate insert is attacked by the melt coming into contact with it, consideration should also be given to the time during which the contact between the melt and the insert has lasted when determining the rate of lowering. For this purpose provision is therefore made, according to a preferred embodiment of the invention, for the rate of lowering to be increased as the contact time increases. In the formula relation provided for determining the most favorable rate of lowering, this dependence may be incorporated as follows:

$$v_s = \frac{(a_G - a_V) \cdot \Delta h_s \cdot t_C}{k_G \cdot t_{Cref}}$$

where the current material-specific reference contact time $t_{Cref}$ is denoted by $t_C$ and that to be determined empirically for each casting machine is denoted by $t_{Cref}$. The reference contact time $t_{Cref}$ can in this case be determined by a casting test in which the melt material to be cast is cast in combination with the insert ceramic to be used with this melt material in the respective two-roll casting machine without the side plates provided with the ceramic inserts being moved. The reference contact time $t_{Cref}$ is then the average time during which a corresponding groove formation has taken place over the cast length.

A further advantageous embodiment of the invention is characterized in that the side plates are also moved in the axial direction of the casting rolls towards their front sides assigned to them at a force-superimposed, for example axial rate of movement. With this combined adjustment of the side plates in the axial direction of the casting rolls and direction of conveying of the cast strip it is ensured at all times that the side plates bear against the front sides of the casting rolls with the force required for sealing the casting gap. The movement of the side plates in the axial direction of the casting rolls preferably takes place continuously and parallel to its movement according to the invention in the direction of conveying and as a function, for example, of the high temperature properties of the refractory material used for the side plate inserts, the casting properties of the cast steel, the strip thickness, the rate of lowering active in the direction of conveying of the cast strip, and/or the progress of the formation of the insert.

DETAILED DESCRIPTION OF THE DRAWINGS

The invention is explained in greater detail below with reference to a drawing showing an exemplary embodiment. Diagrammatically:

DESCRIPTION

Figure 1:
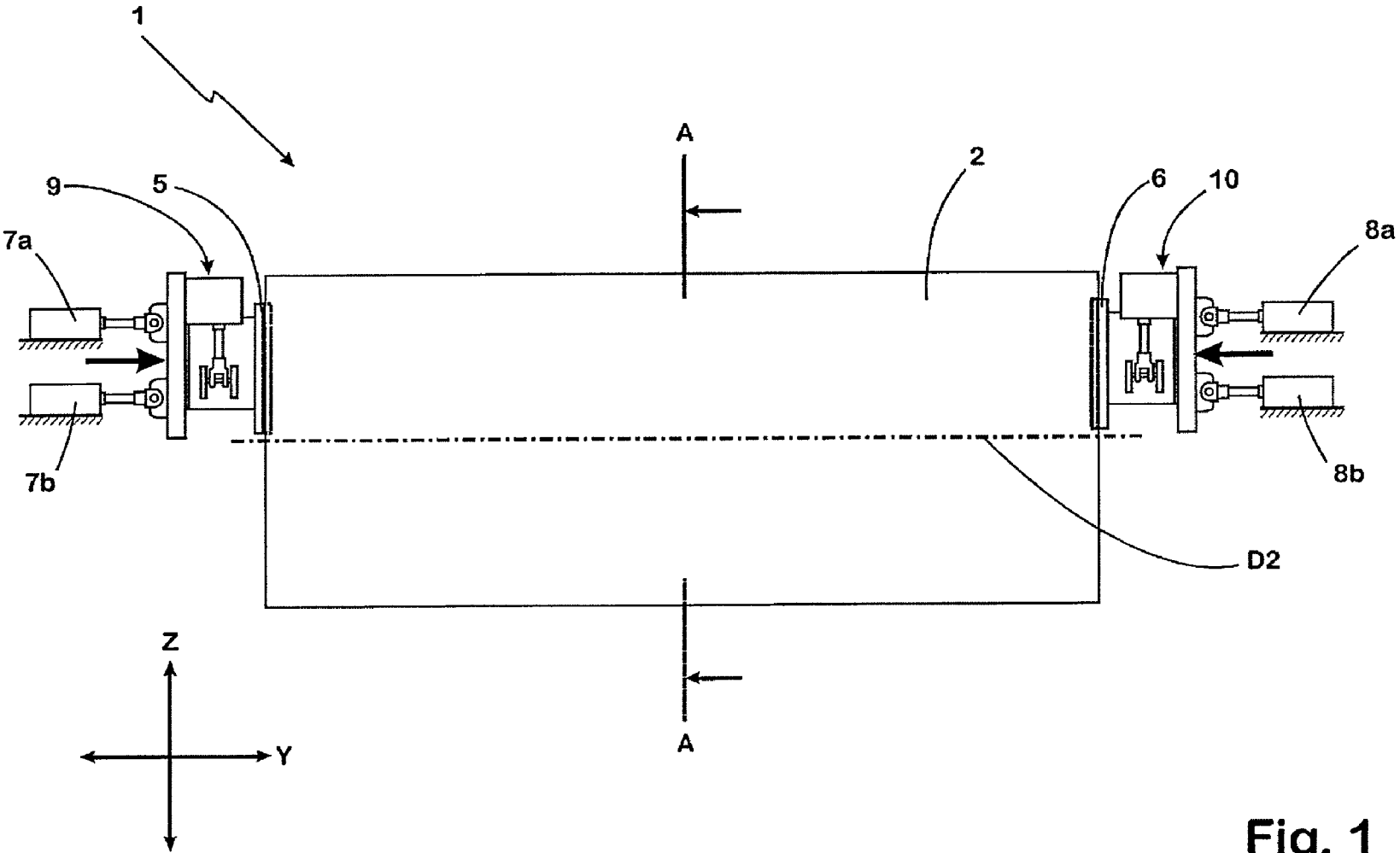
FIG. 1 shows a two-roll casting machine in a lateral view.
Figure 2:
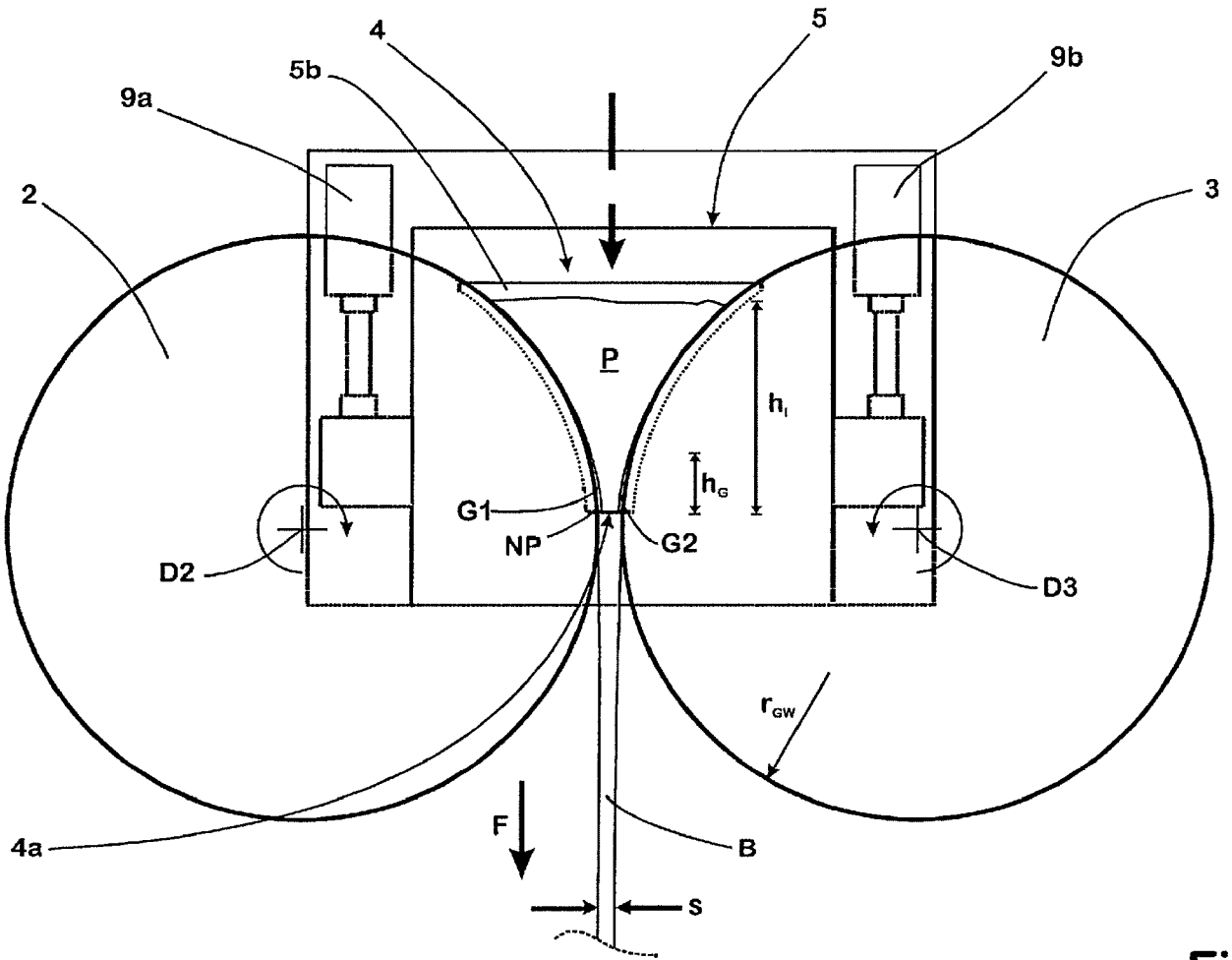
FIG. 2 shows the two-roll casting machine in a section along the line of intersection A-A drawn in FIG. 1.
Figure 3:
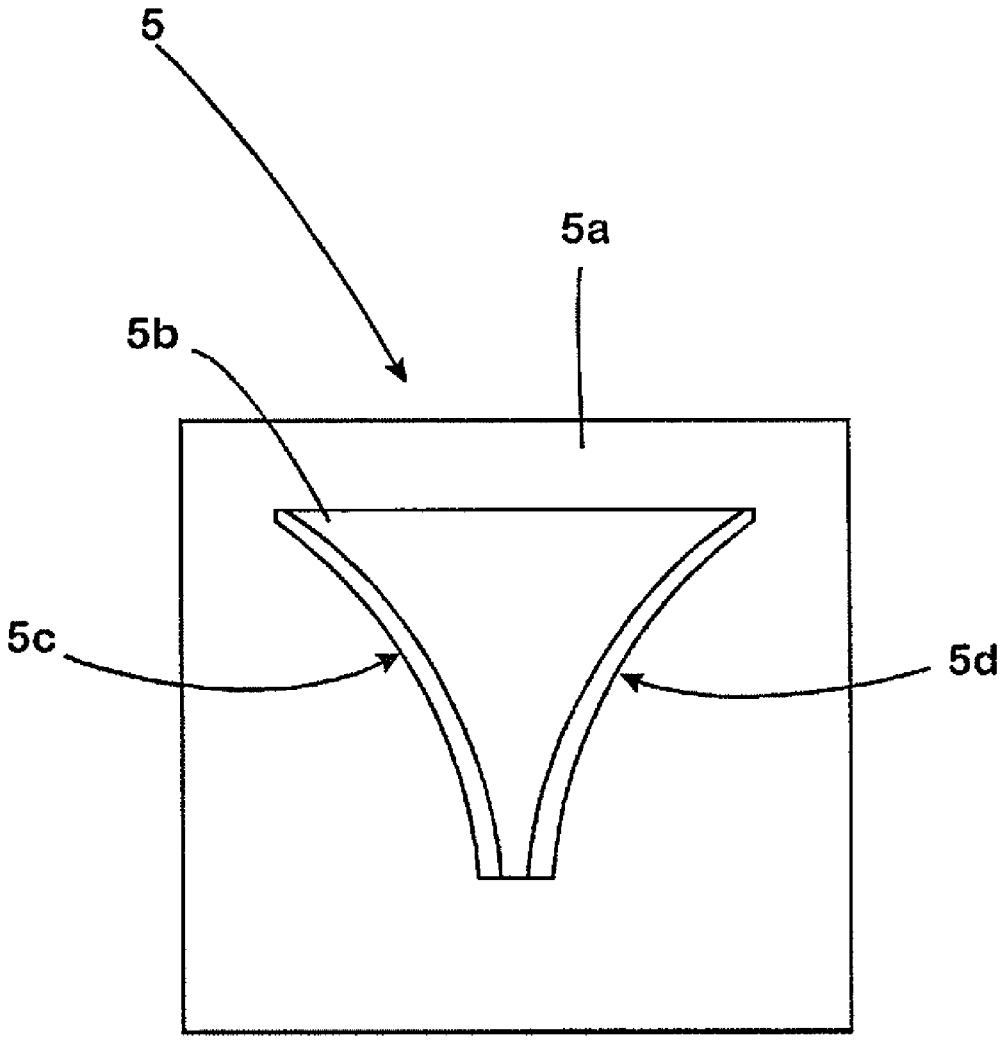
FIG. 3 shows a side plate in a frontal view.

The two-roll casting machine 1 comprises, in addition to a multiplicity of further units not shown here, two casting rolls 2, 3, which are aligned axially parallel to each other in their longitudinal direction, and, between them, delimit a casting gap 4 on their longitudinal sides. Casting rolls 2, 3 rotate in opposite directions about their axes of rotation D2, D3 coinciding with their longitudinal axes and aligned horizontally, in such a manner that their circumferential surfaces enter into casting gap 4 from above. Cast strip B formed in casting gap 4 leaves casting gap 4 at its lower narrow outlet aperture 4*a* in a vertically aligned direction of conveying F.

Both narrow sides of casting gap 4 are each sealed by a side plate 5, 6, which is formed by a support plate 5*a* and an insert 5*b* supported by support plate 5*a* and bearing against the front sides of casting rolls 2, 3 assigned to the respective side plate 5, 6, which insert 5*b* is produced from a ceramic refractory material. Inserts 5*b* of side plates 5, 6, which are designed so that they are wider by a certain over-dimension than each narrow side of casting gap 4, each have a basic triangular shape, according to the shape of the narrow sides of casting gap 4, in whose sides 5*c*, 5*d* assigned to the circumferential faces of casting rolls 2 and 3 respectively arc-shaped grooves are formed when side plates 5, 6 are inserted in a known manner by means of casting rolls 2, 3, due to specific abrasive wear, the radius of which grooves is adapted to the circumferential radius $r_{GW}$ of casting rolls 2, 3. Inserts 5*b* of side plates 5, 6 therefore seal tightly, in the condition prepared for the casting operation, against both the front sides and the circumferential faces of casting rolls 2, 3.

In the axial direction of casting rolls 2, 3, side plates 5, 6 are pressed against the front faces of casting rolls 2, 3 assigned to them by adjusting devices 7*a*, 7*b*, 8*a*, 8*b* acting in acting direction Y aligned horizontally along axes of rotation D2, D3 of casting rolls 2, 3 with a contact force required for a permanent seal and/or at a force-superimposed, for example axial rate of movement. Here adjusting devices 7*a*, 7*b*, 8*a*, 8*b* act by means of an intermediate plate on side plates 5, 6, on which the respective side plate 5, 6 is displaceably mounted in a vertical direction Z aligned parallel to the direction of conveying F of cast strip B. In addition, the intermediate plate supports a pair 9, 10 of adjusting devices 9*a*, 9*b* acting in vertical acting direction Z parallel to direction of conveying F, one adjusting device 9*a* of which is arranged on the side of side plates 5, 6 assigned to the one casting roll 2 and the other adjusting device 9*b* of which is arranged on the side assigned to the other casting roll 3.

To produce strip B, cast for example from a steel melt, the steel melt is poured into casting gap 4 when casting rolls 2, 3 are rotating against each other at a certain peripheral speed, so that a melt pool P is formed above outlet aperture 4*a* of the gap, the bath level of which pool is located at a height h1 above outlet aperture 4*a* of casting gap 4. The melt hitting the circumferential face of casting rolls 2, 3 solidifies there so that a strip shell forms on each of casting rolls 2, 3. These strip shells are entrained by casting rolls 2, 3 in the direction of outlet aperture 4*a* of casting gap 4 until they meet each other at the so-called nip-point NP and are pressed there together with cast strip B to be produced.

At the beginning of the casting operation side plates 5, 6 are lowered continuously at a certain lowering rate by adjusting devices 9, 10 assigned to each of them in the vertical acting direction Z parallel to direction of conveying F of cast strip B. In this manner, the height and hence the expansion of the grooves G1, G2 are continuously minimized by the constant after-loading of insert material, which grooves are unavoidably formed between the circumferential faces of casting rolls 2, 3 and lateral faces 5*c*, 5*d* of inserts 5, 6 bearing against them as a result of the abrasive wear due to the contact of the respective insert 5, 6 with the steel melt solidifying in casting gap 4.

If a strip B with a strip thickness s of 3 mm is to be cast from a steel melt, a lowering rate of 0.86 mm per km of cast strip is obtained at a height $h_1$ of the melt pool bath level above outlet aperture 4*a* of casting gap 4 of 400 mm, a height difference $h_s$ of the individually observed grooves G1, G2 to nip-point NP of casting gap 4 of 300 mm, a circumferential radius $r_{GW}$ of casting rolls 2, 3 of 750 mm, an axial groove formation rate $a_G$ of 1.5 mm/km, an axial feed rate $a_v$ of 1.0 mm/km, a critical groove depth $k_G$ of 1.0 mm and an exponent n of 0.5 determined empirically from the so-called root-t law using the above-mentioned formula relations $$s_G = \frac{(h_1 - h_G)^n \cdot s}{h_1^n \cdot 2},$$

$$\Delta h_s = h_G - \sqrt{\left(\left(s_G + \sqrt{r_{GW}^2 - h_L^2}\right)^2 - r_{GW}^2\right) * -1},$$

and $$v_S = \frac{(a_G - a_V) \cdot \Delta h_s}{k_G}$$

for lowering side plates 5, 6 in acting direction Z.

If the axial feed rate $a_v$ for extending the life of the respective insert 5, 6 is to be reduced to 0.75 mm/km of cast strip, for example, the vertical lowering rate is increased to 1.29 mm/km of cast strip according to the formula relation indicated above. As the axial feed rate is reduced, the required vertical lowering rate must therefore be increased to avoid grooves.

If the influence of the chemical degradation of the insert which results from contact between the insert and melt is to be compensated for, the respective contact time $t_c$ between the melt and the insert may be considered when calculating the vertical lowering rate $v_s$ according to the following equation:

$$v_S = \frac{(a_G - a_V) \cdot \Delta h_s \cdot t_C}{k_G \cdot t_{Cref}}$$

The reference contact time $t_{Cref}$ is determined empirically for each of the steel materials to be cast and for each casting machine. In principle, it is the case here that the shorter the contact time $t_c$ between the ceramic insert and the melt, the lower the required rate of movement of the ceramic.

The groove formation rates $a_G$ and axial feed rates $a_v$ determined or set for a $SiO_2$ ceramic with an Si content of over 50%, and a melt containing Mn are indicated as a typical example of this dependence in the table below for different contact times tc and Mn contents % Mn.

| | | | | |
|---|---|---|---|---|
| % Mn [% | 0.3 | 1.2 | 0.3 | 1.2 |
| tC [s] | 0.5 | 0.5 | 0.4 | 0.4 |
| aG [mm/km gegossenes Band] | 1.5 | 3.0 | 1.2 | 2.4 |
| aV [mm/km gegossenes Band] | 1.0 | 2.5 | 0.7 | 1.9 |

REFERENCE SYMBOLS

1 Two-roll casting machine
2, 3 Casting rolls
4 Casting gap
4*a* Outlet aperture of casting gap 4
5 Side plate
5*a* Support plate of side plates 5
5*b* Insert of side plates 5
5*c*, 5*d* Sides of insert 5*b* assigned to the circumferential faces of casting rolls 2, 3
6 Side plate
7*a*, 7*b*, 8*a*, 8*b*: Adjusting devices acting in acting direction Y
9 Pair of adjusting devices 9*a*, 9*b*
9*a*, 9*b* Adjusting devices acting in acting direction Z
10 Pair of adjusting devices 9*a*, 9*b*
B Cast strip
D2, D3 Axes of rotation of casting rolls 2, 3
F Direction of conveying of the cast strip
G1, G2 Grooves
h1 Height of the melt pool bath level above outlet aperture 4*a* of casting gap 4
$h_G$ Height difference of the individually observed grooves G1, G2 to the nip-point NP of casting gap 4
NP Nip-point
P Melt pool
$r_{GW}$ Circumferential radius of casting rolls 2, 3
s Thickness of strip B
Y Horizontally aligned acting direction
Z Vertically aligned acting direction

The invention claimed is:

1. Method for operating a two-roll casting machine for casting molten metal into cast strip, which the machine has two casting rolls which are each rotatively driven in opposite directions about an axis of rotation and between them delimit a casting gap on its longitudinal sides, with side plates that can be placed on the casting rolls, which the side plates seal the casting gap on its narrow sides in the casting operation since they bear against the front sides of the casting rolls, bridging the casting gap with a refractory material, wherein the side plates are moved during the casting operation in a vertical direction which is aligned parallel to the direction of conveying in which the cast strip leaves the casting gap, and wherein gap-like grooves are formed in the refractory material of the side plates as the operating time increases, wherein a lowering rate $v_s$ at which the side plates are lowered in the vertical direction, as a function of the cast length of the cast strip, is set according to the following equation:

$$v_S = \frac{(a_G - a_V) \cdot \Delta h_s}{k_G}$$

where $v_s$: is the lowering rate in mm per km of cast strip, $a_G$: is the rate at which the gap-like grooves are formed in the axial direction, in mm per km of cast strip, $a_v$: is the feed rate of an optionally performed movement of the side plates in the axial direction in mm per km of cast strip, $k_G$: is the critical depth of the gap-like groove in mm, $\Delta h_s$: is the minimum amount by which the side plates are adjusted during the casting operation to avoid the consequences of the formation of a gap-like groove per running kilometer of cast strip in the vertical direction, calculated according to the following formula relation (in mm):

$$\Delta h_s = h_G - \sqrt{\left(\left(s_G + \sqrt{r_{GW}^2 - h_L^2}\right)^2 - r_{GW}^2\right) * -1}$$

$$s_G\text{: } s_G = \frac{(h_1 - h_G)^n \cdot s}{h_1^n \cdot 2}$$

$h_l$: height of the bath level;

$h_G$: height difference of the individually observed gap-like groove to a point of the casting gap at which the solidified strip shells meet on n: 0.5-0.65;

$r_{GW}$: circumferential radius of the casting rolls;

s: thickness of the cast strip.

2. Method according to claim 1, wherein the side plates are moved by 0.1 mm to 50 mm per kilometer of cast strip in the vertical direction.

3. Method according to claim 2, wherein the side plates are moved by 0.5 mm to 1.5 mm per kilometer of cast strip in the vertical direction.

4. Method according to claim 1, wherein the side plates are additionally moved in the axial direction of the casting rolls against their front sides assigned to each of them.

5. Method according to claim 4, wherein the side plates are moved continuously in the axial direction of the casting rolls as a function of the cast length of the cast strip in each case.

6. Method according to claim 1, wherein the side plates are lowered in an accelerated manner when the melt emerges on its lower edges in the direction of conveying of the strip until the melt has fully emerged.

* * * * *

UNITED STATES PATENT AND TRADEMARK OFFICE

CERTIFICATE OF CORRECTION

PATENT NO. : 7,938,167 B2
APPLICATION NO. : 12/094054
DATED : May 10, 2011
INVENTOR(S) : André d'Hone and René Leenen It is certified that error appears in the above-identified patent and that said Letters Patent is hereby corrected as shown below:

On the cover page, the title is incorrect,
delete "METHOD AND DEVICE FOR TREATING A SURFACE OF A WORK PIECE"
and replace it with
-- METHOD OF OPERATING A TWIN-ROLL CASTING MACHINE FOR CASTING MOLTEN METAL INTO CAST STRIP --

Signed and Sealed this
Twenty-sixth Day of July, 2011

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,938,167 B2
APPLICATION NO. : 12/094054
DATED : May 10, 2011
INVENTOR(S) : André d'Hone and René Leenen It is certified that error appears in the above-identified patent and that said Letters Patent is hereby corrected as shown below:

Title Page, Item (54) and at Column 1, lines 1 and 2, the title is incorrect,
delete "METHOD AND DEVICE FOR TREATING A SURFACE OF A WORK PIECE"
and replace it with
-- METHOD OF OPERATING A TWIN-ROLL CASTING MACHINE FOR CASTING MOLTEN METAL INTO CAST STRIP --

This certificate supersedes the Certificate of Correction issued July 26, 2011.

Signed and Sealed this
Twenty-third Day of August, 2011

David J. Kappos

David J. Kappos
*Director of the United States Patent and Trademark Office*